United States Patent [19]

Mickelsson

[11] 4,126,260

[45] Nov. 21, 1978

[54] MACHINE FOR DRIVING FASTENERS INTO OBJECTS

[75] Inventor: Conny O. Mickelsson, Hestra, Sweden

[73] Assignee: Isabergs Verkstads AB, Hestra, Sweden

[21] Appl. No.: 780,108

[22] Filed: Mar. 22, 1977

[30] Foreign Application Priority Data

May 17, 1976 [SE] Sweden ..... 7605579

[51] Int. Cl.[2] ..... B25C 5/10

[52] U.S. Cl. ..... 227/132

[58] Field of Search ..... 227/132, 146; 267/36 A, 267/158, 160

[56] References Cited

U.S. PATENT DOCUMENTS

| | | | |
|---|---|---|---|
| 2,156,496 | 5/1939 | Handwerk | 267/158 |
| 2,493,640 | 1/1950 | Peterson | 227/132 |
| 2,602,350 | 7/1952 | Marcellus | 267/158 |
| 3,185,141 | 5/1965 | Miracki et al. | 267/158 |

FOREIGN PATENT DOCUMENTS

| | | | |
|---|---|---|---|
| 245,459 | 11/1946 | Switzerland | 227/132 |
| 255,111 | 6/1948 | Switzerland | 227/132 |
| 807,937 | 1/1959 | United Kingdom | 227/132 |

*Primary Examiner*—Granville Y. Custer, Jr.
*Attorney, Agent, or Firm*—Irvin A. Lavine

[57] ABSTRACT

In a machine for driving a fastener, e.g. a nail, a staple or the like by one impact blow into an object by means of a driver actuating the fastener and connected to one end of a bar-shaped spring which extends between a plurality of spring supports, said supports being distributed throughout the length of the spring and said driver being reciprocable in a tensioning stroke for tensioning and bending the spring about at least one of the supports and in a striking stroke generated by the tensional force of the spring for driving the fastener into the object, the invention provides the improvement that at least one of the supports is adjustable for regulating the tensional force of the spring in order to control the energy released in the striking stroke.

5 Claims, 6 Drawing Figures

8
6
10
11
9
12b,12a
28
7
13
14
II
III
31
30
15
43
60
50
44
53
54
51
52
19
20
22
24
23
3
4
1
5
18
21
16
17
2
26
29

MACHINE FOR DRIVING FASTENERS INTO OBJECTS

This invention relates to a machine for driving a fastener such as a nail, a staple or like element by one impact blow into an object by means of a driver actuating the fastener and connected to one end of a bar-shaped spring which extends between a plurality of spring supports, said supports being distributed throughout the length of the spring and said driver being reciprocable in a tensioning stroke for tensioning and bending the spring about at least one of the supports and in a striking stroke generated by the tensional force of the spring for driving the fastener into the object.

Such machines are disclosed for instance in U.S. Pat. No. 2,493,640.

When such machines are used in practice problems often arise with regard to the driving force. A greater driving force is required for driving the fastener into a hard object than into a soft object. Besides, such machines are often designed in such a way that they can operate with fasteners of different length, e.g. both long and short staples. A relatively great amount of energy is required to drive a long staple into a hard material. A considerably smaller amount of energy is required to drive a short staple, particularly into a soft material. If the machine is designed to deliver a large amount of energy but only a small amount of said energy is spent in the driving operation, the driver will damage the material to be fastened. Moreover, a large proportion of the energy will be taken up by a damping means in the machine or be transferred via said damping means to the frame of the machine where it produces unnecessarily high stresses.

This invention relates to an improved machine of the type described above which permits adapting the amount of energy delivered by the machine to the amount of energy which is required to drive the fastener into a certain object.

To this end, at least one of the supports is adjustable for regulation of the tensional force of the spring.

Embodiments of the present invention will be more fully described hereinbelow with reference to the accompanying drawings in which.

Figure 1:
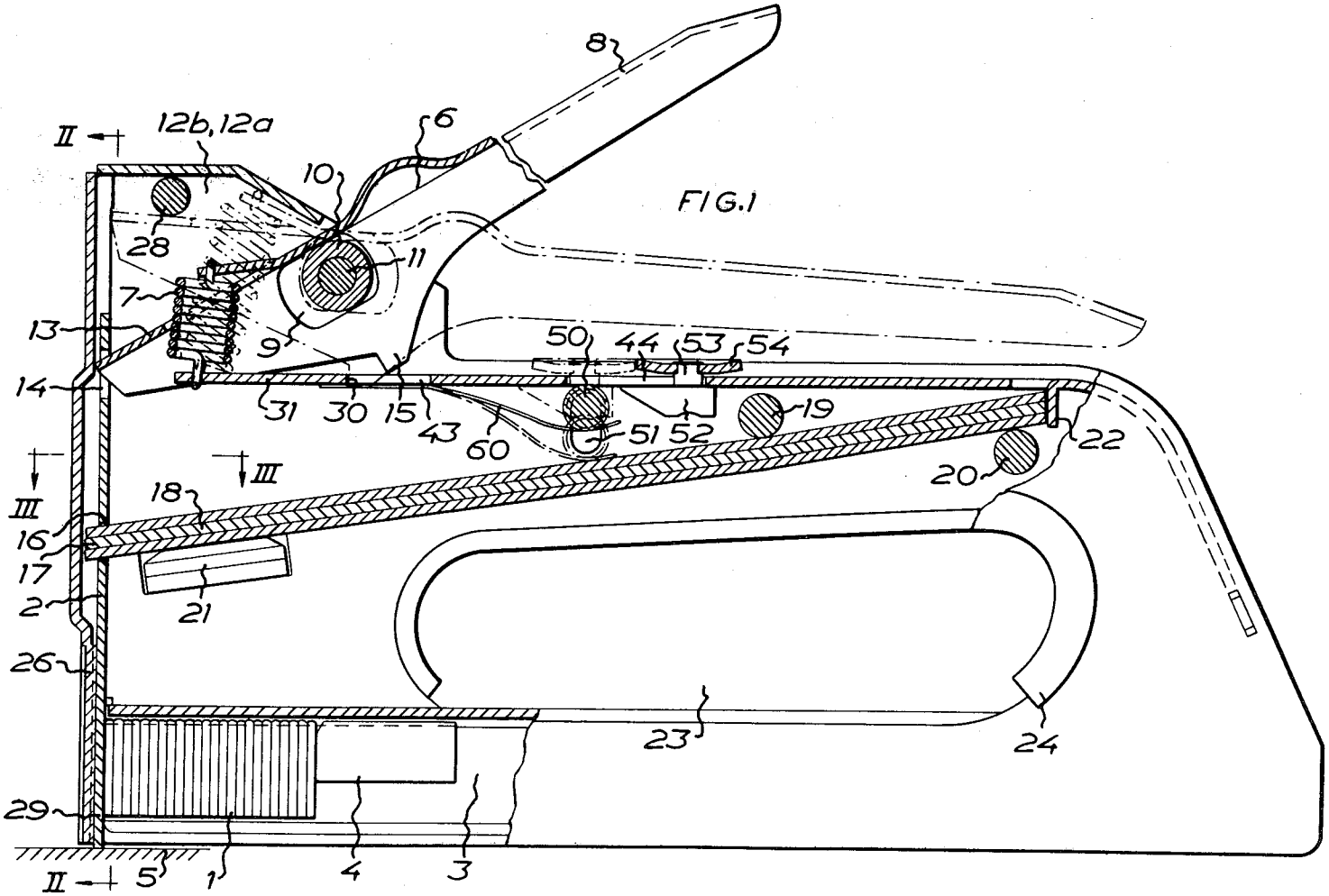
FIG. 1 is a side view, partly in section, of a machine according to the invention.
Figure 6:
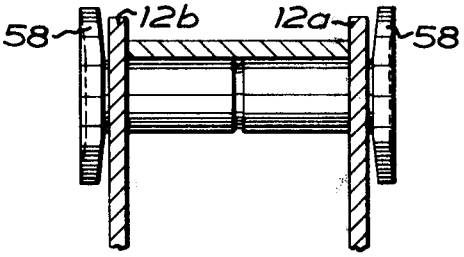
Figure 4:
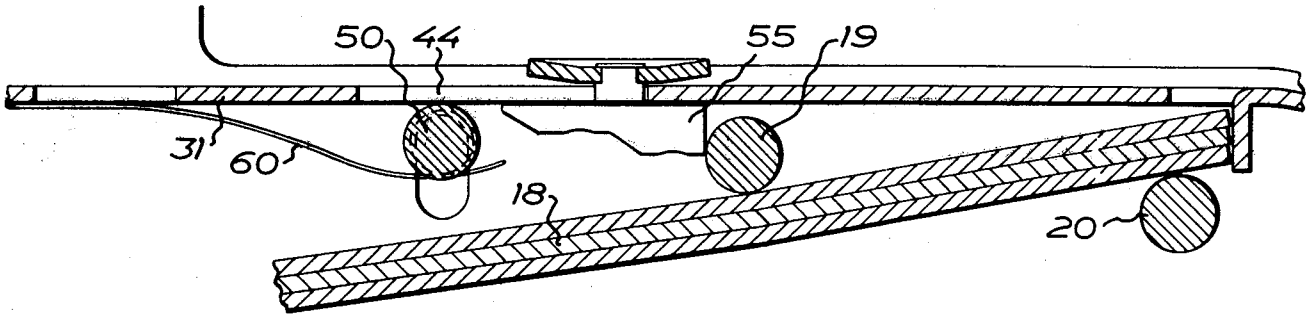
Figure 5:
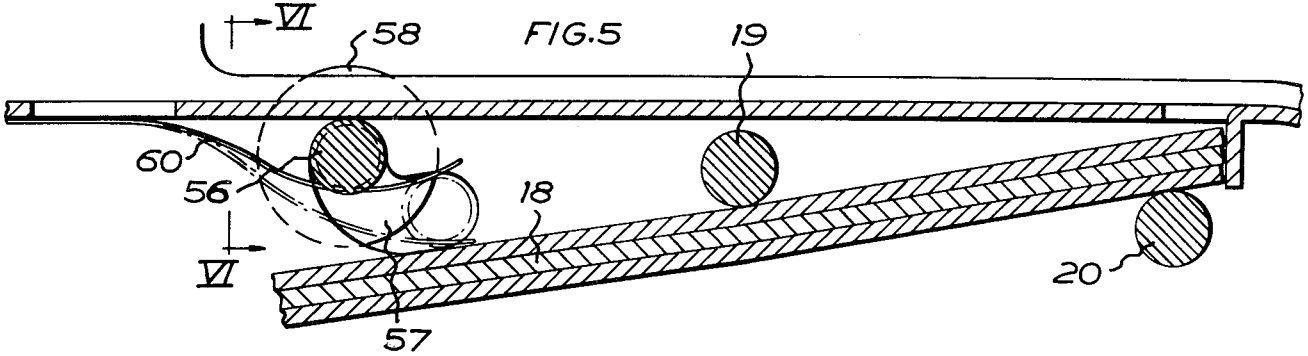

FIGS. 4 and 5 correspond to part of FIG. 1 but show modified embodiments of the invention; and FIG. 6 is a cross-section taken on line VI—VI in FIG. 5.

Figure 2:
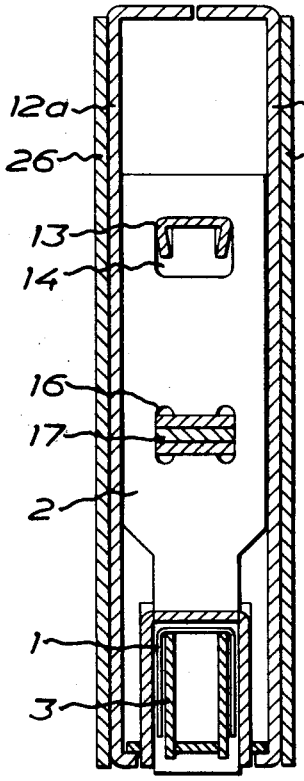
FIG. 2 is a section taken on line II—II in FIG. 1.
Figure 3:
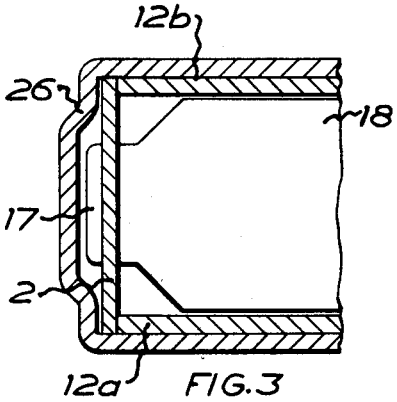
FIG. 3 is a section taken on line III—III in FIG. 1.

FIGS. 1 to 3 show a manually operated machine for driving staples 1 into an object 5. The staples 1 are located in a prior art staple magazine 3 which includes a spring operated supply means 4 which urges the staples 1 against the front end of the machine.

The frame of the machine consists of two side plates 12*a* and 12*b* which at the front end of the machine are closed and encompassed by a front plate 26. The staple magazine 3 is mounted between the side plates 12*a* and 12*b*. A cover plate 31 extends along those longitudinal edges of the side plates 12*a* and 12*b* which are opposed to the magazine 3. A shaft 28 which serves as a stop is disposed between the side plates 12*a* and 12*b*. Further, two shafts 19 and 20 are disposed between the plates 12*a* and 12*b* to serve as supports for a bar-shaped spring which in the embodiments illustrated is in the form of a laminated leaf spring 18. One end of the spring 18 is supported by a lug 22 punched out of the cover plate 31 close to the support 20, and in the position of rest illustrated in FIG. 1 the spring engages near its other end a damping means 21 of some suitable material which is arranged between the side plates 12*a* and 12*b*. The support 20 and the damper 21 are disposed at the underside of the spring 18, and the support 19 engages the upper side of the spring at some distance from the support 20 and in the position of rest illustrated holds the spring 18 urged against the support 20 and the damper 21 under a certain tension. A shaft 11 carrying a roller 10 is disposed between the side plates 12*a* and 12*b*, said roller being freely rotatable on the shaft 11.

The side plates 12*a* and 12*b* furthermore have a recess 23 for the fingers of the hand by which the machine is to be handled. A profile member 24 is arranged for the protection of the fingers between the side plates 12*a* and 12*b* in at least that part of the recess 23 with which the fingers will engage. The profile member 24 is preferably made of plastics.

For driving the staples 1 successively into objects the machine has a driver 2 of the shape illustrated in FIGS. 1, 2 and 3. The driver 2 is guided between the front plate 26 and the side plates 12*a* and 12*b* and bears against the inner side of the front plate 26 in at least the portion thereof which is to co-operate with a staple 1. In the position of rest of the machine the staples are urged against the inner side of the driver 2, and the front end of the driver 2 protrudes through the outlet opening 29 of the machine. The driver 2 also has a recess 16 for the end 17 of the spring 18, which end extends through the recess 16 and thus is in firm engagement with the driver 2. This is illustrated more in detail in FIGS. 2 and 3. The driver 2 has a further recess 14 for the end 13 of a release lever 6 in the form of a handle. The end 13 of the lever 6 extends, as will appear most clearly from FIG. 1, inwardly through the recess 14 in the driver 2.

The lever 6 is mainly U-shaped and each limb has an elongated hole 9. The roller 10 on the shaft 11 extends through the holes 9, whereby the lever 6 can be pivoted about the roller 10 and the shaft 11. The holes 9 being elongated, the lever 6 is also longitudinally movable on the roller 10 and the shaft 11. The lever 6 is anchored in the cover plate 31 between the pivot axis of the lever 6 and the end 13 thereof by means of a tension spring 7 which keeps the lever 6 in the position illustrated in FIG. 1 in which all parts of the machine occupy their positions of rest. On a level with its pivot axis the lever 6 further has a protrusion 15 directed towards the cover plate 31 which has a recess 43 for said protrusion 15. The edge 30 of the recess is adapted to co-operate with the protrusion 15 in such a way that the lever 6 after engagement between the protrusion 15 and the edge 30 is longitudinally shifted on the roller 10 and the shaft 11 whereby the end 13 is moved out of its engagement with the driver 2. This position of the lever 6 is illustrated more in detail by dotted lines in FIG. 1. When the lever 6 occupies the dotted line position the driver 2 is entirely free from the lever end 13, and in this position the end 13 engages the shaft 28. The tension spring 7 serves to return the lever 6 to the full line position.

To drive a staple into the object 5 the arm 8 of the lever 6 must be urged in the direction towards the cover plate 31. When the lever 6 is swung the end 13 thereof will be moved upwards and thus lift the driver 2 because the end 13 is in engagement with the recess 14 in the driver 2. When the driver 2 is lifted the spring 18 will be bent about the support 19 and thereby tensioned. Tensioning of the spring 18 will proceed until the lever end 13 leaves the recess 14 in the driver 2. When this occurs the end of the driver in the outlet opening 29 has been raised over the staple next to said opening and after the driver 2 has been disengaged from the end 13 of the lever 6 the spring 18 will accelerate the driver 2 and force the staple into the object 5.

After release of the driver 2 the force of the tensioned spring 18 will move the driver 2 downwards so that it pushes the staple 1 through the outlet opening 29 and drives it into the object 5. The spring 18 will be arrested and stopped when it reaches the damper 21. As the end 17 of the spring 18 engages the recess 16 of the driver 2 the driver 2 will also be stopped in its lower position. If the lever 6 is released the tension spring 7 will shift the lever to the position shown in FIG. 1. It should be observed that the tension spring 7 also moves the lever 6 longitudinally in such a way that the end 13 protrudes into the recess 14 when the lever is in the FIG. 1 position. As in all other conventional staple driving machines the staples 1 are continuously supplied by the supply means 4 so that the machine is in readiness for feeding another staple immediately after the preceding staple has been driven into the object.

The parts, so far described, of the machine are of priorart design and operate in a previously known manner.

According to the invention, an additional support 50 for the bar-shaped spring 18 is provided in the embodiment illustrated in FIGS. 1 to 3 at some distance from the support 19 in the direction towards the damper 21. The support 50 is in the form of a shaft which is movable in vertical grooves 51 in the side plates 12*a* and 12*b*. A spring wire 60 secured to the cover plate 31 bears against the support 50 and tends to hold it raised into engagement with the cover plate 31 in the inoperative position shown in FIG. 1, in which the support 50 is constantly out of touch with the spring 18. A wedge member 52 bears against the underside of the cover plate 31 and has a pin 53 which extends through a slot 44 in the cover plate 31 and carries on the upper side of said plate an operating button 54. The wedge member 52 is movable from the position shown by full lines in FIG. 1 to the position shown by dotted lines, in which the wedge member has engaged and forced the support 50 downwards away from the cover plate 31 to the position shown by dotted lines, in which the support 50 bears against or is close to the bar-shaped spring 18.

If the lever 6 of the machine is actuated with the support 50 in the position into which it has been lowered by the action of the wedge member 52 the spring 18 will be tensioned and bent about the support 50 instead of the support 19 whereby the tensional force of the spring will be greater than in the case when the spring is bent about the support 19. The spring 18 is therefore capable of forcing the driver 2 downwards with greater energy, e.g. for driving longer staples into harder objects.

FIG. 4 shows a modification in which the wedge member 55 is stepped so that it is able when moved towards the support 50 to set said support at either of two distances from the cover plate 31 and the spring 18, respectively. In this embodiment it is thus possible to set three different striking strengths of the spring 18.

In the embodiment according to FIGS. 5 and 6 a spring support in the form of a shaft 56 is movably mounted in L-shaped slots 57 in the side plates 12*a* and 12*b* and carries operating buttons 58 externally of said plates. A spring 60 tends to hold the support 56 at the upper ends of the slots 57 in an inoperative position so that the striker spring 18 when tensioned is bent about the support 19. With the aid of the buttons 58 the support 56 can be moved downwards to the lower end of the slots 57 so that the striker spring 18 when tensioned is instead bent about the support 56 to provide a greater striking force.

The invention must not be considered limited to the embodiments described above and illustrated above and illustrated in the drawings, as other embodiments are conceivable, for instance making the support 19 and/or the support 20 movable in one or more steps or infinitely for regulating the tensional force of the striker spring 18.

What I claim and desire to secure by Letters Patent is:

1. In a machine for driving fasteners by an impact blow into an object, said machine having support means, a fastener driver means mounted on said support means for reciprocation thereon, an elongated bar-shaped spring having one end connected to said fastener driver means and being mounted on said support means at the other end, said fastener driver means and said spring being engageable so that movement of said driver in a first direction to a first position causes said spring to bend to store energy for subsequently moving said driver means in a second direction to provide an impact blow to said fastener, the improvement comprising:

a supplemental support means for said spring, said supplemental support means being movably mounted on said support means for movement from an inoperative position away from said spring to an operative position in which said supplemental support means is engaged by said spring as it is bent to store energy, said supplemental support means and said spring being engageable so that the effective length of said spring is decreased whereby movement of said driver means to said first position will cause said spring to bend to store relatively more energy than when said supplemental support means is in its inoperative position and the effective length of said spring is relatively greater;

said supplemental support means further comprising a bar movably mounted in slots defined by said support means, said bar being perpendicular to the longitudinal axis of said spring, and wedge means movably mounted on said support means, said wedge means positioning said bar in a fixed pre-selected position relative to said spring whereby the amount of energy stored in said spring during bending can be preselected depending upon the position of said bar.

2. The invention of claim 1 wherein a resilient means is provided on said support means to urge said bar against said wedge.

3. The invention of claim 1 wherein said wedge means engages said bar to position the same in said fixed pre-selected position relative to said spring.

4. The invention of claim 1 wherein said wedge means engages said bar to position the same in a plurality of pre-selected positions relative to said spring.

5. In a machine for driving fasteners by an impact blow into an object, said machine having support means, a fastener driver means mounted on said support means for reciprocation thereon, an elongated bar-shaped spring having one end connected to said fastener driver means and being mounted on said support means at the other end, said fastener driver means and said spring being engageable so that movement of said driver in a first direction to a first position causes said spring to bend to store energy for subsequently moving said driver means in a second direction to provide an impact blow to said fastener, the improvement comprising:

a supplemental support means for said spring, said supplemental support means being movably mounted on said support means for movement from an inoperative position away from said spring to an operative position in which said supplemental support means is engaged by said spring as it is bent to store energy, said supplemental support means and said spring being engageable so that the effective length of said spring is decreased whereby movement of said driver means to said first position will cause said spring to bend to store relatively more energy than when said supplemental support means is in its inoperative position and the effective length of said spring is relatively greater;

said supplemental support means further comprising a bar movably mounted in arcuate slots defined by said support means, said bar being perpendicular to the longitudinal axis of said spring, a resilient means is provided on said support means to urge said bar into the extremeties of said slots, one of the extremities of said slots being remote from said spring and defining said inoperative position and the other extremeties of said slots being adjacent said spring and defining said operative position for said bar.

* * * * *